US006610369B2

(12) United States Patent
Byrnes et al.

(10) Patent No.: US 6,610,369 B2
(45) Date of Patent: Aug. 26, 2003

(54) METHOD OF PRODUCING THERMALLY SPRAYED METALLIC COATING

(75) Inventors: Larry Edward Byrnes, Rochester Hills, MI (US); Martin Stephen Kramer, Clarkston, MI (US); Richard A. Neiser, Albuquerque, NM (US)

(73) Assignees: General Motors Corporation, Detroit, MI (US); Sandia National Laboratories, Albuquerque, NM (US)

( * ) Notice: Subject to any disclaimer, the term of this patent is extended or adjusted under 35 U.S.C. 154(b) by 0 days.

(21) Appl. No.: 10/022,322

(22) Filed: Dec. 13, 2001

(65) Prior Publication Data

US 2003/0113472 A1 Jun. 19, 2003

(51) Int. Cl.[7] ..... B05D 1/08; C23C 4/06
(52) U.S. Cl. ..... 427/449; 427/453; 427/456
(58) Field of Search ..... 427/449, 453, 427/456

(56) References Cited

U.S. PATENT DOCUMENTS

| | | | | |
|---|---|---|---|---|
| 4,687,678 A | * | 8/1987 | Lindblom | 427/453 |
| 5,014,916 A | | 5/1991 | Trapani et al. | 239/85 |
| 5,148,986 A | | 9/1992 | Rusch | 239/85 |
| 5,271,967 A | | 12/1993 | Kramer et al. | 427/455 |
| 5,275,336 A | | 1/1994 | Stasi et al. | 239/84 |
| 5,380,564 A | | 1/1995 | VanKuiken, Jr. et al. | 427/456 |
| 5,592,927 A | | 1/1997 | Zaluzec et al. | 123/668 |
| 5,626,674 A | | 5/1997 | VanKuiken, Jr. et al. | 118/317 |
| 5,820,938 A | | 10/1998 | Pank et al. | 427/449 |
| 6,485,792 B1 | * | 11/2002 | Grylls et al. | 427/456 |

OTHER PUBLICATIONS

Hong et al, "Impurity Effects on Adhesion: Nb, C, O, B, and S at a Mo/$MoSi_2$ Interface," *Physical Review B*, vol. 47, No. 20, May 15, 1993, pp. 13 615–13 625.

Rabiei et al, "Microstructure, Deformation and Cracking Characteristics of Thermal Spray Ferrous Coatings," *Materials Science and Engineering A269*, 1999, pp. 152–165 (no month date).

Sigler, "Adherence Behavior of Oxide Grown in Air and Synthetic Exhaust Gas on Fe–Cr–Al Alloys Containing Strong Sulfide–Forming Elements: Ca, Mg, Y, Ce, La, Ti, and Zr," *Oxidation of Metals*, vol. 40, Nos. 5/6, 1993, pp. 555–583 (no month date).

* cited by examiner

*Primary Examiner*—Katherine A. Bareford
(74) *Attorney, Agent, or Firm*—Cary W. Brooks

(57) ABSTRACT

The cylinder walls of light metal engine blocks are thermally spray coated with a ferrous-based coating using an HVOF device. A ferrous-based wire is fed to the HVOF device to locate a tip end of the wire in a high temperature zone of the device. Jet flows of oxygen and gaseous fuel are fed to the high temperature zone and are combusted to generate heat to melt the tip end. The oxygen is oversupplied in relation to the gaseous fuel. The excess oxygen reacts with and burns a fraction of the ferrous-based feed wire in an exothermic reaction to generate substantial supplemental heat to the HVOF device. The molten/combusted metal is sprayed by the device onto the walls of the cylinder by the jet flow of gases.

15 Claims, 1 Drawing Sheet

METHOD OF PRODUCING THERMALLY SPRAYED METALLIC COATING

The inventions claimed in this application were made under Government Contract No. CRADA SC92/1104 and in which the government may have rights.

TECHNICAL FIELD

This invention relates generally to methods for spray coating the cylinder walls of a light metal engine block using a high velocity oxygen fuel (HVOF) system and more particularly the application of ferrous-based coatings.

BACKGROUND OF THE INVENTION

It is known in the art to thermally spray coat the cylinder walls of aluminum engine blocks with a ferrous-based material using high velocity oxygen-fuel (HVOF) systems. Examples of prior HVOF systems include those disclosed in U.S. Pat. Nos. 5,014,916; 5,148,986; 5,275,336; 4,578,114 and 5,334,235, wherein a jet of oxygen and gaseous fuel is ignited within an HVOF gun to melt a feed wire of ferrous-based material which is expelled from the gun by the jet of burning oxygen-fuel onto the surface of the cylinder wall. The rate of application is limited by the rate of melting of the wire feed material.

It is an object of the present invention to increase the efficiency of such HVOF systems.

SUMMARY OF THE INVENTION

A method of thermally spray coating a cylinder wall of a light metal engine block includes providing high velocity oxygen-fuel (HVOF) device and advancing a feed wire of ferrous-based material into the HVOF device to locate a tip end of the wire in a high temperature zone of the HVOF device. High velocity jet flows of oxygen and gaseous fuel are supplied to the high temperature zone and combusted to generate sufficient heat to melt the tip end of the feed wire and spraying the molten feed wire material onto the cylinder wall of the engine block. According to a characterizing feature of the invention, the supply of the oxygen to the HVOF device is controlled in order to provide an oversupply of oxygen to the high temperature zone of the HVOF device in excess of the oxygen required for stoichiometric combustion of the gaseous fuel. The excess oxygen reacts with an associated fraction of the ferrous-based feed material in the high temperature zone to combust the associated fraction of the feed material as a source of solid fuel to generate a supplemental source of heat to the high temperature zone of the HVOF device.

The invention has the advantage of oversupplying oxygen to the HVOF device so as to consume a fraction of the ferrous-based feed material as a source of solid fuel so as to increase the temperature and intensity of heating in the high temperature zone, thereby substantially increasing the rate at which the ferrous-based feed material can be converted by the HVOF device as a sprayed coating on the cylinder walls. Consequently, the method of the present invention provides a more efficient process for thermally spraying ferrous-based coatings onto cylinder wall substrates in an HVOF system, increasing the application rate of the coating material and greatly increasing the number of cylinder wall surfaces that can be coated in a given time, and makes it possible to process a cylinder block using the HVOF system without use of cooling water flow in the water jacket of the block.

The invention has the further advantage of providing a simple solution for increasing the efficiency and application rate of HVOF systems with the use of standard materials, namely use of standard oxygen and gaseous fuel types and ferrous-based feed material through control of the oxygen flow relative to the gaseous fuel flow.

Still a further advantage of the invention is that the high heat capacity generated from burning the fraction of feed material decreases the dependence on the gaseous fuel as the sole source of heat for melting the feed material in the high temperature zone. The supplemental heat generated through burning of the feed material enables the user of the present invention to select from a variety of gaseous fuels, including some low cost fuels which, on their own, may not provide sufficient heat in an HVOF system for acceptable performance of the system. However, supplemented by the burning of the feed material as a solid fuel source, these otherwise inadequate gaseous fuel sources become viable as low cost alternatives in an HVOF system as the gaseous fuel source.

A further advantage of the invention is that the burning of a fraction of the ferrous-based feed material produces iron oxides which are incorporated as part of the thermally sprayed coating. The presence of iron oxide particles increases the wear resistance of the thermally sprayed coating.

According to a further aspect of the invention, aluminum may be added to the ferrous-based feed material to lower the oxygen content in the sprayed coating and to alter the form of oxide from FeO to $FeAl_2O_4$. FeO is a metastable oxide phase that can transform over time at engine operating temperatures to $Fe_3O_4$ in a volume expanding reaction. $FeAl_2O_4$ is a stable oxide phase that is not subject to any transformations at engine operating temperatures. The presence of the aluminum in the oxide further enhances the wear resistance properties of the thermally sprayed coating and is less brittle than a coating having FeO oxides.

According to a still further aspect of the invention, additives are included in the iron-based feed material to control embrittlement from impurities such as sulfur. According to the invention, introducing yttrium, calcium, magnesium, titanium, zirconium, hafnium, cerium, or lanthanum has the beneficial effect of tying up impurities so as to eliminate their ability to segregate to interfaces such as grain boundaries to reduce or eliminate embrittlement caused by such impurities.

BRIEF DESCRIPTION OF THE DRAWINGS

A preferred embodiment of the invention is disclosed in the following description and in the accompanying drawings, wherein.

DESCRIPTION OF THE PREFERRED EMBODIMENT

Figure 1:
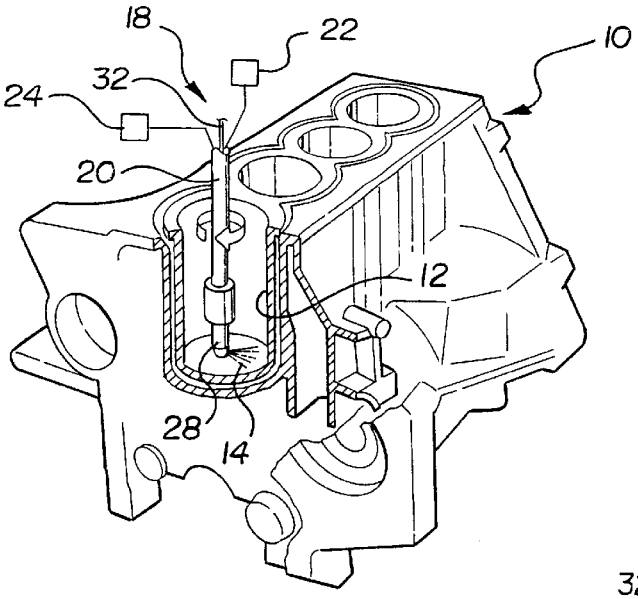
FIG. 1 is a schematic isometric view of a cast aluminum engine block shown partly broken away and in section and illustrating the process of coating the walls of the cylinders according to the invention.
Figure 2:
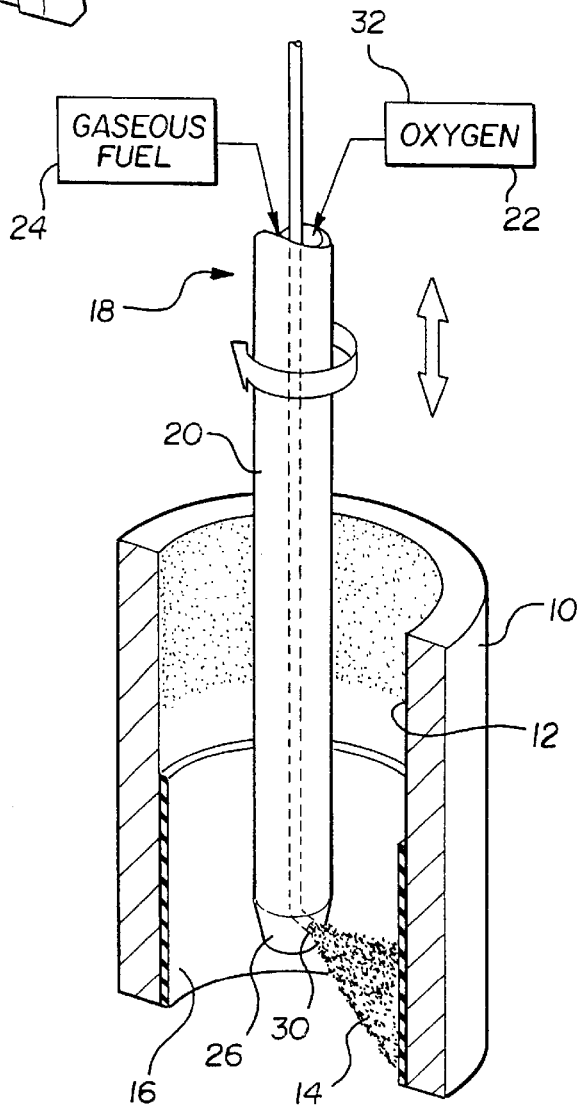
FIG. 2 is an enlarged fragmentary sectional view of a cylinder of the block being coated according to the invention.

FIG. 1 shows a schematic representation, partly in section and broken away, of an engine block 10 for a four-cylinder engine having four cylinder chambers defined therein by cylinder walls 12. The block 10 is cast of a lightweight metal, such as aluminum, magnesium or alloys thereof.

According to the invention, a spray 14 of atomized ferrous-based material is applied to the cylinder walls 12 to form thereon a thermally sprayed coating 16 of the material. The cylinder walls 12 are initially cleaned such as by water etching according to known practice. The coating 16 is applied by using a high velocity oxygen-fuel (HVOF) thermal spray device 18 and practices which are generally known to the art, but modified according to the invention as will be described below. The HVOF metal spray gun device 18 has one or more tubular coating heads 20 which are extended into the open cylinders of the block 10 in spaced relation to cylinder walls 12 as illustrated schematically in the drawings. According to HVOF practice, a jet flow of oxygen, originating from oxygen source 22, and a jet flow of gaseous fuel, originating from gas source 24, are directed through the coating head 20 and ignited to combust the gaseous fuel 24 in a high temperature zone 26 of the coating head 20 adjacent a nozzle 28 of the coating head 20. Once ignited, the flame of the burning gases is self-sufficient.

Material for the coating 16 is supplied to the HVOF spray gun 18 where it is melted in the high temperature zone 26 and blown by the jet of high velocity gases out of the nozzle 28 through a nozzle opening 30 and deposited onto the inner surface of the cylinder walls 12. The ferrous-based feed material 32 is preferably supplied in wire form and fed, preferably as a single wire, down through the coating head 20, where its lower tip end enters the high temperature zone 26 and is melted by the burning gases. The coating head 20 is automatically rotated about the feed wire 32 and is reciprocated in the longitudinal direction of the cylinder as generally described in U.S. Pat. No. 5,080,056, which is owned by the assignee of the present invention and its disclosure incorporated herein by reference.

The standard HVOF practice in applying such coatings is modified according to the invention as follows. According to one aspect of the invention, the flow of oxygen to the high temperature zone 26 is controlled such that the volume of oxygen supplied to the high temperature zone 26 exceeds the amount of oxygen required for stoichiometric combustion of the gaseous fuel 24 supplied to the high temperature zone 26. In other words, there is an excess supply of oxygen delivered to the high temperature zone 26 beyond that required to burn the gaseous fuel 24. According to the invention, this excess oxygen supply reacts exothermically with the ferrous-based feed material 32 in the high temperature zone and actually burns or combusts (not just melts but consumes) a fraction of the feed material 32 in the temperature zone 26 to generate substantial heat, such that the ferrous-based feed material 32 serves as a source of solid fuel as well as a coating material. The burning of the fraction of feed material within the coating head 20 provides a supplemental heat source beyond that provided by the combustion of the fuel gas 24, greatly increasing the temperature environment in the high temperature zone 26. The usage of the feed material in part as a solid fuel has several practical advantages which will be discussed below. For the feed material 32 to serve most effectively as a heat-generating solid fuel source, the over supply of oxygen should be about twice the amount needed for stoichiometric combustion of the gaseous fuel 24.

There are several advantages which are recognized by preparing and applying a thermal spray coating of ferrous-based material according to the invention, wherein excess oxygen is supplied to burn a fraction of the feed material as a solid fuel source. The temperature generated from the combustion of the gaseous fuel 24 is hot enough to melt the iron-based feed material (having a melting point less than about 2,800° F.) but does not reach the boiling or combustion temperature of iron, which is about 5,400° F. The over supply of oxygen reacts at high temperature with a fraction of the molten ferrous-based feed material 32 within the coating head 20 and the exothermic reaction reaches temperatures sufficient to burn the fraction of feed material which, consequently, releases heat and increases the overall temperature in the high temperature zone 26. The increased temperature environment accelerates the wire deposition rate. On studies conducted with and without burning of the iron-based feed material, it was found that about 17 pounds of feed material are deposited per hour according to the invention, whereas about seven pounds per hour are deposited when oxygen levels are kept at about stoichiometric levels. Accordingly, the deposition rate is increased by more than twofold.

Another advantage of using the iron-based feed material as a solid fuel is that it is a rather inexpensive source of fuel. Low carbon steel, for example, in wire form is relatively inexpensive and readily obtainable on the market. In addition, using the iron-based feed material 32 as a fuel source presents opportunities to select from gaseous fuel sources 24 which might not otherwise be suitable or sufficient in an HVOF system. Prior U.S. Pat. No. 5,080,056 discloses uses of propylene as the fuel source in an HVOF system which burns at a temperature of about 5,000° F. According to the invention, other more readily available gaseous fuel sources may be used, such as natural gas, which is already supplied to most major manufacturing facilities and would be an inexpensive alternative to the usual propylene. Another readily available inexpensive gaseous fuel alternative is propane. Propylene has a higher heat content than either methane or propane and, on its own, would be more suitable for general HVOF applications. However, it is generally more costly and the relatively high heat content may not be required in the HVOF process according to the invention where oxygen is oversupplied at a rate sufficient to burn a fraction of the ferrous-based feed material as a solid fuel source. Consequently, less costly, more readily available gaseous fuels, such as methane and propane mentioned above, can be used, among others, even though they might on their own lack the heat content of more costlier fuels like propylene.

Another significant advantage of using the ferrous-based feed material as a solid fuel source is that it results in a greater application rate of the thermally sprayed coating material, and thus a greater number of cylinder bore walls can be coated in a given time as compared to operating an HVOF system without usage of the feed material as a solid fuel source. Still a further advantage recognized by the present method is that the higher deposition rate on the walls of the cylinder allow the coating to be applied in a shorter time duration, and thus there is less heating of the substrate block material as a result of the coating process than that caused when using only a gaseous fuel source in an HVOF system. Consequently, it is possible to coat the walls of the cylinder liners without providing auxiliary cooling to the block.

A further advantage of burning a fraction of the ferrous-based feed material is that the byproducts of the consumption of the solid fuel are metallic oxides, which get incorporated into the spray coating and increase the wear resistance of the coating 16. When low carbon steel wire is used as the feed material 32, Wustite (FeO) is the predominant oxide generated from burning of the feed material and which gets incorporated into the coating 16. However, it is preferred to incorporate aluminum into the steel wire 32 which has the effect of reducing the oxygen content in the spray coating 16 and altering the oxide formed. With an iron-based feed wire 32, the spray coating 16 has about 8–12 wt. % FeO or about 35–55 vol. % FeO but most preferably 10–12 wt. % FeO. By adding about 1.5 to 3.0 wt. % aluminum (and preferably 2.0–2.5 wt. %) to the iron-based feed wire 32, the oxide is altered from Wustite (FeO) to predominantly Hercynite ($FeAl_2O_4$). Everything else being equal, the Hercynite is present in the coating in a range of about 3–7 wt. %. The addition of the aluminum thus has two advantages. Firstly, by reducing the oxygen content, the overall metal oxide content is reduced from 8–12 wt. % FeO to 3–7 wt. % $FeAl_2O_4$. While oxides have beneficial wear characteristics, they also make the coating more brittle, and the 3–7 wt. % range retains beneficial wear properties while reducing the brittleness of the spray coating. Secondly, Wustite (FeO) is a metastable oxide phase that can transform over time at engine operating temperatures to magnetite ($Fe_3O_4$) with a corresponding volume expansion. Hercynite ($FeAl_2O_4$) is a stable oxide phase (spinel) that is not subject to any transformations at engine operating temperatures.

A 3/16-inch diameter low carbon wire fed to the HVOF coating head 20 in which methane is fed at a rate of 100–150 SCFH and oxygen fed at a rate of 600 SCFH produced a consumption rate of the wire feed at about 36 inches per minute, as compared to a stoichiometric flow rate of oxygen of 250 SCFH with the same gas flow producing a consumption rate of the wire feed material at about 14 inches per minute.

The preferred coating 16 has a thickness of about less than 0.2 mm and preferably in the range of 0.050–0.175 mm, and the cycle time for thermal spray coating the wall of a cylinder of an aluminum block with about 0.150 mm finished coating thickness is about 60 seconds when using the feed wire 32 as a solid fuel source, as compared to a cycle time of about 160 seconds for HVOF coating where stoichiometric combustion of gas is employed.

In addition to the aluminum, other additives may be added to the low carbon iron feed stock wire 32 to inhibit impurity embrittlement of the thermal spray coating. As the molten droplets of coating material are sprayed onto the surface of the cylinder walls 12, they immediately quench and solidify, with the droplets building upon one another to produce a dense coating. However, the presence of sulfur and other relatively large impurity atoms may be particularly damaging as embrittling agents if present in the coating materials, as they tend to segregate to the internal interfaces of the coating (such as grain boundaries and the surfaces of the individual droplets) which can inhibit the adhesion properties of the coating and can lead to spalling. The embrittling effects of such impurities can be lessened or eliminated by the addition of yttrium, calcium, magnesium, titanium, zirconium, hafnium, cerium and/or lanthanum. For example, it has been found that the addition of less than 1 wt. % of yttrium is sufficient to eliminate the effects of sulfur embrittlement in the steel thermal spray coating of the invention. Similar percentages of the other anti-embrittlement agents are contemplated. The aluminum and anti-embrittlement additives may be supplied to the high temperature zone 26 of the HVOF coating head as an alloyed feed stock wire 32, as a coating applied to the low carbon feed stock wire, or may be separately added as a composite wire.

The disclosed embodiments are representative of presently preferred forms of the invention, but are intended to be illustrative rather than definitive thereof. The invention is defined in the claims.

What is claimed is:

1. A method of thermally spray coating a cylinder wall of a metal engine block, said method comprising:

providing a high velocity oxygen fuel (HVOF) device;

advancing a feed wire of ferrous-based material into the HVOF device to locate a tip end of the wire in a high temperature zone of the HVOF device;

supplying a high velocity jet flow of gaseous fuel to the high temperature zone of the HVOF device;

supplying a high velocity jet flow of oxygen to the high temperature zone of the HVOF device and combusting the oxygen and fuel to generate sufficient heat in the high temperature zone to melt the tip end of the feed wire in the high temperature zone and spraying the molten feed wire material onto the cylinder wall surface of the engine block forming a coating thereon; and controlling the flow of the oxygen relative to the flow of the gaseous fuel to provide an oversupply of oxygen in excess of the oxygen required for stoichiometric combustion of the gaseous fuel, and reacting the excess oxygen with an associated fraction of the wire feed material in the high temperature zone to combust the associated fraction of the wire feed material as a source of solid fuel to provide a supplemental source of heat to the high temperature zone of the HVOF device, and wherein the amount of oversupply of oxygen is sufficient to increase the deposition rate of the molten metal on the cylinder wall by more than twofold than that deposited when oxygen is supplied at that required for stoichiometric combustion of the gaseous fuel.

2. The method of claim 1 wherein the oxygen is oversupplied in an amount about at least twice that needed for stoichiometric combustion with the fuel.

3. The method of claim 2 wherein the ferrous-based material reacts with oxygen to produce a coating having 8–12 weight percent FeO.

4. The method of claim 1 wherein the oversupply of oxygen is in an amount about twice that needed for stoichiometric combustion with the fuel.

5. The method of claim 1 wherein the metal engine block comprises at least one of aluminum, magnesium and alloys thereof.

6. The method of claim 1 wherein the gaseous fuel comprises at least one of methane and propane.

7. A method of thermally spray coating a cylinder wall of a metal engine block, said method comprising:

providing a high velocity oxygen fuel (HVOF) device;

advancing a feed wire of ferrous-based material into the HVOF device to locate a tip end of the wire in a high temperature zone of the HVOF device;

supplying a high velocity jet flow of gaseous fuel to the high temperature zone of the HVOF device;

supplying a high velocity jet flow of oxygen to the high temperature zone of the HVOF device and combusting the oxygen and fuel to generate sufficient heat in the high temperature zone to melt the tip end of the feed wire in the high temperature zone and spraying the molten feed wire material onto the cylinder wall surface of the engine block forming a ferrous-based coating thereon; and controlling the flow of the oxygen relative to the flow of the gaseous fuel to provide an oversupply of oxygen in excess of the oxygen required for stoichiometric combustion of the gaseous fuel, and reacting the excess oxygen with an associated fraction of the wire feed material in the high temperature zone to combust the associated fraction of the wire feed material as a source of solid fuel to provide a supplemental source of heat to the high temperature zone of the HVOF device; and wherein the ferrous-based coating includes additions of aluminum, and wherein the amount of oversupply of oxygen is sufficient to increase the deposition rate of the molten metal on the cylinder wall by more than twofold than that deposited when oxygen is supplied at that required for stoichiometric combustion of the gaseous fuel.

8. The method of claim 7 wherein the oxygen is oversupplied in an amount about twice that needed for stoichiometric combustion with the fuel.

9. The method of claim 7 wherein the aluminum is added in an amount ranging from about 0.5 to 3.0 weight percent of the ferrous-based coating.

10. The method of claim 9 wherein the aluminum is present in the range of 1.5 to 2.5 weight percent.

11. The method of claim 7 wherein the aluminum reacts in the HVOF device with the ferrous-based coating to produce $FeAl_2O_4$ oxides in the applied coating.

12. The method of claim 7 wherein the ferrous-based material reacts with aluminum and oxygen to form $FeAl_2O_4$ in the coating.

13. The method of claim 12 wherein the coating comprises 3 to 7 weight percent $FeAl_2O_4$.

14. The method of claim 7 wherein the metal engine block comprises at least one of aluminum, magnesium and alloys thereof.

15. The method of claim 7 wherein the gaseous fuel comprises at least one of methane and propane.

* * * * *